United States Patent [19]

Middleman et al.

[11] 4,317,027

[45] Feb. 23, 1982

[54] CIRCUIT PROTECTION DEVICES

[75] Inventors: Lee M. Middleman, Portola Valley; Joseph H. Evans, Palo Alto, both of Calif.

[73] Assignee: Raychem Corporation, Menlo Park, Calif.

[21] Appl. No.: 142,054

[22] Filed: Apr. 21, 1980

[51] Int. Cl.[3] ..... H05B 3/10

[52] U.S. Cl. ..... 219/553; 219/505; 219/510; 219/548; 252/511; 264/105; 338/22 R; 338/212

[58] Field of Search ..... 219/504, 505, 510, 528, 219/548, 549, 552, 553; 252/511; 264/105; 338/122 R, 225 D, 212; 174/DIG. 8

[56] References Cited

U.S. PATENT DOCUMENTS

| | | | |
|---|---|---|---|
| 3,351,882 | 11/1967 | Kohler et al. | 338/322 |
| 4,017,715 | 4/1977 | Whitney et al. | 219/553 |
| 4,177,376 | 12/1979 | Horsma et al. | 219/553 |
| 4,177,446 | 12/1979 | Diaz | 219/549 X |
| 4,238,812 | 12/1980 | Middleman et al. | 219/523 X |

FOREIGN PATENT DOCUMENTS

| | | | |
|---|---|---|---|
| 2024579 | 1/1980 | United Kingdom | 219/549 |

OTHER PUBLICATIONS

"Investigation of Current-Interruption by Metal Filled Epoxy Resin" by Littlewood and Briggs, *J. Phys. D: Appl. Phys.,* vol. II, 1978, pp. 1457-1462.

"PTC Resistor", R. F. Blaha, *Proceedings of the Electronic Components Conference,* 1971, pp. 44-50.

"Solid State Bistable Power Switch Study", H. Shulman and J. Bartko, Aug. 1968, *National Aeronautics and Space Administration,* under Contract No. NAS 12-647.

*Primary Examiner*—Volodymyr Y. Mayewsky

*Attorney, Agent, or Firm*—Lyon & Lyon

[57] ABSTRACT

Electrical devices which comprise two planar electrodes and a conductive polymer element, at least a part of which is a PTC element. The conductive polymer element has an intermediate portion of increased resistance, resulting from the presence of insulating or high resistance portions within the conductive polymer element, so that when a hot zone is formed in the PTC element, it is located at or near the intermediate portion, away from the electrodes.

16 Claims, 1 Drawing Figure

CIRCUIT PROTECTION DEVICES

BACKGROUND OF THE INVENTION

1. Field of the Invention

This invention relates to circuit protection devices which comprise conductive polymer PTC elements.

2. Summary of the Prior Art

Conductive polymer PTC compositions are well known, and for details of recent developments relating to such compositions and devices comprising them, reference may be made for example to U.S. Pat. Nos. 4,017,715 (Whitney et al.), 4,177,376 (Horsma et al.) and U.S. Ser. Nos. 608,660 (Kampe), now abandoned, 750,149 (Kamath et al.), now abandoned, 732,792 (Van Konynenburg et al.), now abandoned, 751,095 (Toy et al.), now abandoned, 798,154 (Horsma et al.), now abandoned, 873,676 (Horsma), now U.S. Pat. Nos. 4,246,468, 965,343 (Van Konynenburg et al.) now U.S. Pat. Nos. 4,237,441, 965,344 (Middleman et al), now U.S. Pat. Nos. 4,238,812, 965,345 (Middleman et al.) now abandoned, 6,773 (Simon) now U.S. Pat. Nos. 4,255,698, 41,071 (Walker), and 97,711 (Middleman et al). It has been proposed to use devices comprising PTC elements to protect circuits against fault conditions arising from excessive temperatures and/or circuit currents—see for example U.S. Pat. Nos. 2,978,665 (Vernet et al.), 3,243,753 (Kohler) and 3,351,882 (Kohler), U.K. Pat. No. 1,534,715, the article entitled "Investigations of Current Interruption by Metal-filled Epoxy Resin" by Littlewood and Briggs in J. Phys D: Appl. Phys, Vol. II, pages 1457–1462, and the article entitled "The PTC Resistor" by R. F. Blaha in Proceedings of the Electronic Components Conference, 1971, and the report entitled "Solid State Bistable Power Switch Study" by H. Shulman and John Bartko (August 1968) under Contract NAS-12-647, published by the National Aeronautics and Space Administration. However, it is only very recently, as described in U.S. Ser. Nos. 965,344 (Middleman et al.) now U.S. Pat. No. 4,238,812 and 6,773 (Simon) now U.S. Pat. No. 4,255,698, that circuit protection devices comprising conductive polymer PTC elements have become a practical reality.

The disclosure of each of the patents, patent applications and publications referred to above is incorporated by reference herein.

A problem which arises in the use of electrical heaters comprising PTC elements is that when a PTC element is heated by passage of current through it to a temperature at which it is self-regulating, a very large proportion of the voltage drop over the PTC element nearly always takes place over a very small proportion of the element. This small proportion is referred to herein as a "hot zone", and is referred to in the prior art as a "hot line". As discussed in U.S. Pat. No. 4,177,376 (Ser. No. 601,638), the result of hot zone formation, especially in heaters which comprise wire electrodes joined by a strip of PTC material, is that the heater is less efficient. U.S. Pat. No. 4,177,376 describes electrical devices, especially heaters, which comprise a layer of a PTC material with a contiguous layer of constant wattage (or ZTC) material, so that the hot zone is of greater area at right angles to the direction of current flow.

U.S. Pat. No. 3,351,882 (Kohler) discloses electrical resistors comprising a PTC conductive polymer element which has end portions of relatively large cross-sectional area and a constricted intermediate portion of relatively small cross-section, and generally planar electrodes of substantial cross-sectional area (typically of "meshed" construction) embedded in the end portions of the PTC element; the PTC element is cross-linked at least around the electrodes. The stated object of using such electrodes is to provide a relatively low and uniform current density around the electrodes and thus avoid the localized overheating which occurs with other type of electrode, causing deterioration of the PTC material and undesirable variations of the paths of current flow. The stated object of having a constricted intermediate portion in the PTC element is to ensure that the end portions will not reach the critical temperature (at which the PTC conductive polymer increases sharply in resistivity) because the greater current density in the intermediate portion results in the intermediate portion first reaching the critical temperature and thus reducing the current through the resistor. In one embodiment of Kohler's invention, an axial hole runs through the electrodes and the PTC element for ventilation purposes.

SUMMARY OF THE INVENTION

In further developing electrical devices comprising planar electrodes and conductive polymer PTC elements, we have found that although the use of an external restriction in the PTC element, as taught by Kohler, improves the performance of the device, still better results can be obtained, especially as the d/t ratio, as defined in Ser. No. 965,344 (Middleman et al), is increased, by restricting the effective cross-section of an intermediate portion of the conductive polymer element by placing within the periphery thereof at least one portion of substantially higher resistivity, e.g. composed of insulating material.

In one embodiment the invention provides an electrical device which comprises (1) a conductive polymer element, at least a part of which is a PTC element, and (2) two substantially planar electrodes which can be connected to a source of electrical power and, when so connected, cause current to flow through said PTC element;

said device being such that, if the portion thereof between the electrodes is divided into parallel-faced slices, the thickness of each slice being about 1/5 of the distance between the closest points of the two electrodes and the faces of the slices being planes which are perpendicular to a line joining the closest points of the two electrodes, then there is at least one Type A slice which (a) comprises a part of the PTC element which, when the current through the device is increased rapidly from a level at which the PTC element is in a low temperature, low resistance state to a level which converts the PTC element into a high temperature, high resistance state, increases in temperature at a rate x, and which (b) is free, within the periphery of the conductive polymer element, of portions having a resistivity at 23° C. higher than said conductive polymer and extending through the thickness of the slice, and at least one Type B slice which (a) comprises a part of the conductive polymer element which, when the current through the device is increased rapidly from a level at which the PTC element is in a low temperature, low resistance state to a level which converts the PTC element into a high temperature high resistance state, increases in temperature at a rate y which is greater than x; and (b) comprises, within the periphery of the conductive polymer element, at least one first portion composed of a conductive polymer and at least one second portion comprising a material having a resistivity at 23° C. higher than said conductive polymer;

subject to the proviso that neither of the slices adjacent an electrode is a Type B slice which comprises a part of the PTC element in contiguity with the electrode.

DETAILED DESCRIPTION OF THE INVENTION

Figure 1:
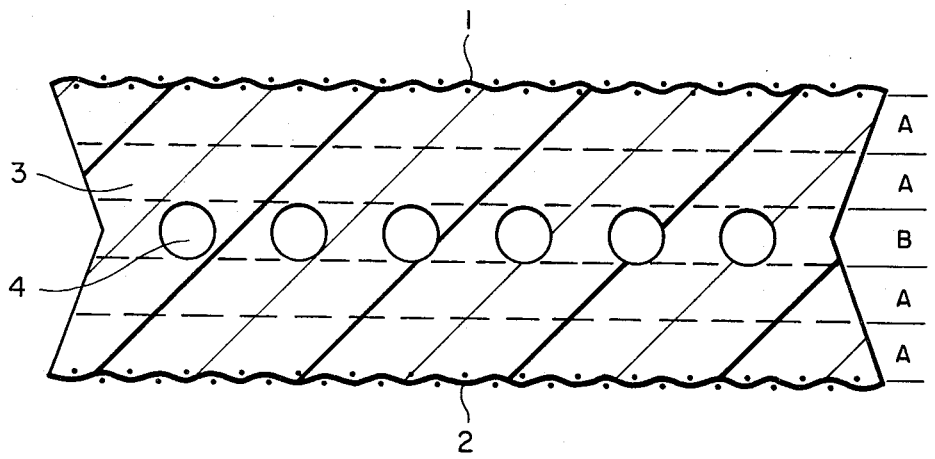
FIG. 1 is a cross-section through a device of the invention.

The planar electrodes used in the present invention may be of the kind described in U.S. Pat. No. 4,238,812 Ser. No. 965,344. There can be more than two electrodes in the device. Their size, in relation to the thickness of the conductive polymer element between them, is preferably as disclosed in Ser. No. 965,344 now U.S. Pat. No. 4,238,812. Thus they may have one or more of the following characteristics.

(a) They are composed of a material having a resistivity of less than $10^{-4}$ ohm.cm and have a thickness such that they do not generate significant amount of heat during operation of the device. The electrodes are typically composed of a metal, nickel or nickel-plated electrodes being preferred.

(b) They are in the form of planar sheets, generally rectangular or circular, preferably of the same dimensions and parallel to each other, on either side of a flat PTC element. Such electrodes may for example have an area of 0.05 to 4.0 $inch^2$, and a length and width of 0.25 to 2.0 inch.

(c) They are in physical (as well as electrical) contact with the PTC element, or separated therefrom by a layer of another conductive material, e.g. a layer of a relatively constant wattage (ZTC) conductive polymer composition.

The PTC element in the devices of the present invention is composed of a PTC conductive polymer composition, preferably one in which the conductive filler comprises carbon black or graphite or both, especially one in which carbon black is the sole conductive filler, especially a carbon black having a particle size, D, which is from 20 to 90 millimicrons and a surface area, S, in $M^2/g$ such that S/D is not more than 10. The resistivity of the PTC composition at 23° C. will generally be less than 100 ohm.cm, especially less than 10 ohm.cm. The composition may be cross-linked or substantially free from cross-linking. Suitable PTC compositions are disclosed in the prior art. The PTC element may be of uniform composition throughout, or it may comprise segments of different composition, as further explained below. Particularly suitable PTC compositions are disclosed in the commonly assigned and contemporaneously filed application of Evans Ser. No. 141,989 (Docket No. MP0715, 175/114), the disclosure of which is incorporated by reference herein.

When the conductive polymer element comprises not only a PTC element but also a constant wattage (CW) element of a conductive polymer exhibiting ZTC behavior, the ZTC conductive polymer can be any of those disclosed in the prior art, preferably one which is compatible with the PTC composition.

Preferred devices of the present invention are circuit protection devices which have a resistance at 23° C. of less than 100 ohms, preferably less than 50 ohms, and may for example have a resistance of 0.01 to 25 ohms. For practical use as a circuit protection device, the size of the device, including any oxygen barrier around the conductive polymer element and the electrodes, is an important consideration. The largest dimension of the device is less than 12 inches, and usually much less, e.g. less than 8 inches, preferably less than 5 inches, especially less than 3 inches, particularly less than 2 inches.

In order to achieve the desired location of the hot zone away from the electrodes, different parts of the conductive polymer element should have different thermal responses to an increase in current which causes the device to trip (i.e. be converted into a high temperature, high resistance state). Furthermore, the part of the conductive element which increases most rapidly in temperature under these circumstances should not be one which comprises a part of the PTC element in contact with an electrode (since the hot zone will then be formed adjacent the electrode). In most cases, a device which shows the desired characteristics, when the device is caused to trip by an increase in current, will also show a qualitatively similar thermal response when the device at 23° C. is first connected to a source of electrical power.

In defining the devices of the invention, reference is made to dividing the portion thereof between the electrodes into five slices of equal thickness. It should be understood that, although the possibility of physically slicing a device is not excluded as a technique for determining whether a particular device falls within the definition, the division of the device into slices can be a notional one, with the thermal response of each slice being determinable from a knowledge of how the device was made and/or from the results of other, more simply effected tests such as physical division of the device along one or a limited number of planes. In preferred devices of the invention, there is a Type A slice and a Type B slice when the portion of the device between the electrodes is divided into three slices (of equal thickness).

It should also be understood that a given slice of the device may be a Type A slice relative to one slice (of Type B) but a Type B slice relative to another slice (of Type A). The proviso that neither of the slices adjacent to an electrode is a Type B slice which comprises a part of the PTC element in contiguity with the electrode means that neither of these slices should be a Type B slice relative to any of the other slices (of Type A).

The Type B slice has a face-to-face resistance at 23° C. which is greater than, preferably at least 1.2 times, especially at least 1.5 times, the face-to-face resistance of the Type A slice, by reason of one or more internal portions which comprise a material having a resistivity at 23° C. higher than the conductive polymer, e.g. a portion which is substantially non-conducting when current is passed through the device, for example one composed of air or another electrical insulator, or a wire having an insulating coating thereon. A fabric composed of an insulating material and having openings therein can be used for this purpose. The area occupied by conductive polymer in at least one cross-section of the Type B slice, parallel to the face, is preferably not more than 0.5 times the area of at least one of the electrodes.

The conductive polymer element can also have an external restriction as taught by U.S. Pat. No. 3,351,882. In addition, the Type B slice can be more efficiently thermally insulated than the periphery of the conductive polymer element in the Type A slice, through the use of thermally insulating material and/or by placing cooling means, e.g. fins, in the vicinity of one or both of the electrodes. A similar method is for the Type B slice to comprise a heating means which may be independent of the $I^2R$ heating of the conductive polymer element by passage of current therethrough between the electrodes.

Referring now to FIG. 1, this shows a cross-section through a device having two square planar electrodes 1 and 2, connected by a PTC element 3 of uniform composition which has a central section of reduced cross-section by reason of internal voids 4. The Type A and Type B slices are identified.

Circuit protection devices which will provide repeated protection against sudden increases in current to high levels and which can make use of the present invention are described in the commonly assigned and contemporaneously filed application of Middleman et al. Ser. No. 141,987 entitled Circuit Protection Devices Comprising PTC Elements (Docket No. MP0713, 157/112), the disclosure of which is incorporated by reference herein.

We claim:

1. An electrical device which comprises (1) a laminar conductive polymer element, at least a part of which is a PTC element, and (2) two substantially planar electrodes which lie either side of the laminar conductive polymer element and which can be connected to a source of electrical power, said electrodes being electrically connected to opposite faces of said conductive polymer element so that when the electrodes are connected to a source of electrical power, they cause current to flow through said PTC element;

said device being such that, if the portion thereof between the electrodes is divided into parallel-faced slices, the thickness of each slice being about 1/5 of the distance between the closest points of the two electrodes and the faces of the slices being planes which are perpendicular to a line joining the closest points of the two electrodes, then there are at least two Type A slices, each of which (a) comprises a part of the PTC element which, when the current through the device is increased rapidly from a level at which the PTC element is in a low temperature, low resistance state to a level whch converts the PTC element into a high temperature high resistance state, increases in temperature at a rate x, and which (b) is free, within the periphery of the conductive polymer element, of portions having a resistivity at 23° C. higher than said conductive polymer and extending through the thickness of the slice, and at least one Type B slice which (a) comprises a part of the conductive polymer element which, when current through the device is increased rapidly from a level at which the PTC element is in a low temperature, low resistance state to a level which converts the PTC element into a high temperature high resistance state, increases in temperature at a rate y which is greater than x; and (b) comprises, within the periphery of the conductive polymer element, at least one first portion composed of a conductive polymer and at least one second portion comprising a material having a resistivity at 23° C. higher than said conductive polymer;

each of the slices adjacent an electrode being a Type A slice.

2. A device according to claim 1 wherein the face-to-face resistance of said Type B slice is at least 1.2 times the face-to-face resistance of said Type A slice.

3. A device according to claim 1 wherein the conductive polymer in the Type A slice has substantially the same resistivity as the conductive polymer in the Type B slice.

4. A device according to claim 3 wherein the conductive polymers in the Type A and Type B slices are the same.

5. A device according to claim 1 wherein the volume enclosed by the periphery of the conductive polymer element in the Type B slice is less than the volume enclosed by the periphery of the conductive polymer element in the Type A slice.

6. A device according to claim 1 wherein the area occupied by conductive polymer in at least one cross-section of the Type B slice, parallel to the face, is less than 0.7 times the area of at least one of the electrodes.

7. A device according to claim 1 wherein said second portion is substantially non-conducting when current is passed through the device at 23° C.

8. A device according to claim 7 wherein the second portion is composed of an insulating material.

9. A device according to claim 1 wherein said conductive polymer element consists essentially of said PTC element.

10. A device according to claim 1 wherein said conductive polymer element includes an element composed of conductive polymer exhibiting ZTC behavior.

11. A device according to claim 1 wherein the periphery of the conductive polymer element in the Type B slice is more efficiently thermally insulated than the periphery of the conductive polymer element in the Type A slice.

12. A device according to claim 1 wherein the Type B slice comprises heating means which is independent of the $I^2R$ heating of the conductive polymer element by passage of current therethrough between the electrodes.

13. A device according to claim 1 which is a circuit protection device whose largest dimension is less than 3 inches and which has a resistance of less than 100 ohms.

14. A device according to claim 13 which has a resistance of 0.01 to 25 ohms.

15. A device according to claim 9 which is a circuit protection device whose largest dimension is less than 3 inches and which has a resistance of less than 50 ohms.

16. A circuit protection device which has a resistance at 25° C. of less than 50 ohms, whose largest dimension is less than 3 inches and which comprises (1) a laminar parallel-sided conductive polymer element which consists essentially of a PTC element;

(2) two substantially planar parallel electrodes which are in direct physical and electrical contact with opposite faces of said laminar conductive polymer element and which can be connected to a source of electrical power, whereby, when the electrodes are connected to a source of electrical power, they cause current to flow through said PTC element; and (3) a plurality of insulating elements which lie within the periphery of the PTC element and which are spaced apart from the electrodes;

whereby if the PTC element is divided into parallel-faced slices, the thickness of each slice being about 1/5 of the distance between the two electrodes and the faces of the slices being parallel to the electrodes, each of the slices adjacent an electrode is free from said insulating elements and at least one of the other, intermediate, slices comprises at least a part of said insulating elements and has at least one cross-section, parallel to the electrodes, in which the area occupied by PTC conductive polymer is less than 0.7 times the area of one of the electrodes.

* * * * *

UNITED STATES PATENT AND TRADEMARK OFFICE

CERTIFICATE OF CORRECTION

PATENT NO. : 4,317,027

DATED : February 23, 1982

INVENTOR(S) : Lee M. Middleman, Joseph H. Evans, Arthur E. Blake and Victor A. Scheff It is certified that error appears in the above-identified patent and that said Letters Patent are hereby corrected as shown below:

In "INVENTORS" on Title Page, add:

-- Arthur E. Blake, Palo Alto;
Victor A. Scheff, Berkeley, both of California --.

Signed and Sealed this

Seventh Day of February 1984

[SEAL]

*Attest:*

GERALD J. MOSSINGHOFF

*Attesting Officer*

*Commissioner of Patents and Trademarks*